United States Patent [19]

Kauserud

[11] Patent Number: 4,646,809

[45] Date of Patent: Mar. 3, 1987

[54] METHOD FOR THE PRODUCTION OF FROZEN MOULD BODIES AND APPARATUS FOR USE IN THE CARRYING OUT OF THE METHOD

[75] Inventor: Hakon Kauserud, Ballerup, Denmark

[73] Assignee: Dansk Industri Syndikat A/S, Herlev, Denmark

[21] Appl. No.: 783,354

[22] Filed: Oct. 3, 1985

Related U.S. Application Data

[63] Continuation of Ser. No. 448,897 filed as PCT DK82/00027, May 3, 1982, published as WO82/03580, Oct. 28, 1982, Pat. No. 4,576,215.

[30] Foreign Application Priority Data

Apr. 13, 1981 [DK] Denmark ..... 1663/81
May 3, 1982 [WO] PCT Int'l Appl. ..... PCT/DK82/00027

[51] Int. Cl.[4] ..... B22C 9/00

[52] U.S. Cl. ..... 164/15; 164/7.1; 164/12

[58] Field of Search ..... 164/7.1, 12, 15, 16, 164/322, 323, 525, 528

[56] References Cited

U.S. PATENT DOCUMENTS

| | | |
|---|---|---|
| 3,008,199 | 11/1961 | Jeppesen . |
| 3,512,571 | 5/1970 | Phelps . |
| 3,749,151 | 7/1973 | George et al. . |
| 3,888,299 | 6/1975 | Bardet . |
| 4,150,704 | 4/1979 | Hoult . |

FOREIGN PATENT DOCUMENTS

| | | |
|---|---|---|
| 2738114 | 3/1979 | Fed. Rep. of Germany . |
| 2912201 | 10/1980 | Fed. Rep. of Germany . |
| 0071037 | 6/1979 | Japan . |
| 0152623 | 12/1979 | Japan . |
| 0006754 | 1/1981 | Japan . |
| 0047241 | 4/1981 | Japan . |
| 0025245 | 2/1982 | Japan . |
| 142944 | 2/1977 | Norway . |
| 356239 | 10/1969 | Sweden . |
| 1537743 | 1/1979 | United Kingdom . |
| 812418 | 3/1981 | U.S.S.R. . |
| 916049 | 4/1982 | U.S.S.R. . |

OTHER PUBLICATIONS

Patent Abstracts of Japan, abstract of JP-56-47241, publ. 1981-04-28.

Patent Abstracts of Japan, abstract of JP-56-47240, publ. 1981-04-28.

Patent Abstracts of Japan, abstract of JP-56-6754, publ. 1981-01-23.

Patent Abstracts of Japan-abstract of JP-55-84250, publ. 1980-06-25.

*Primary Examiner*—Nicholas P. Godici
*Assistant Examiner*—Kurt Rowan
*Attorney, Agent, or Firm*—Fleit, Jacobson, Cohn & Price

[57] ABSTRACT

In the production of frozen moulds (12) or cores the freezing process is accelerated by drawing the liquefied freezing agent, such as nitrogen, used for freezing the water in the mould bodies, into or through the bodies by the application of a vacuum.

3 Claims, 3 Drawing Figures

Figure 1:
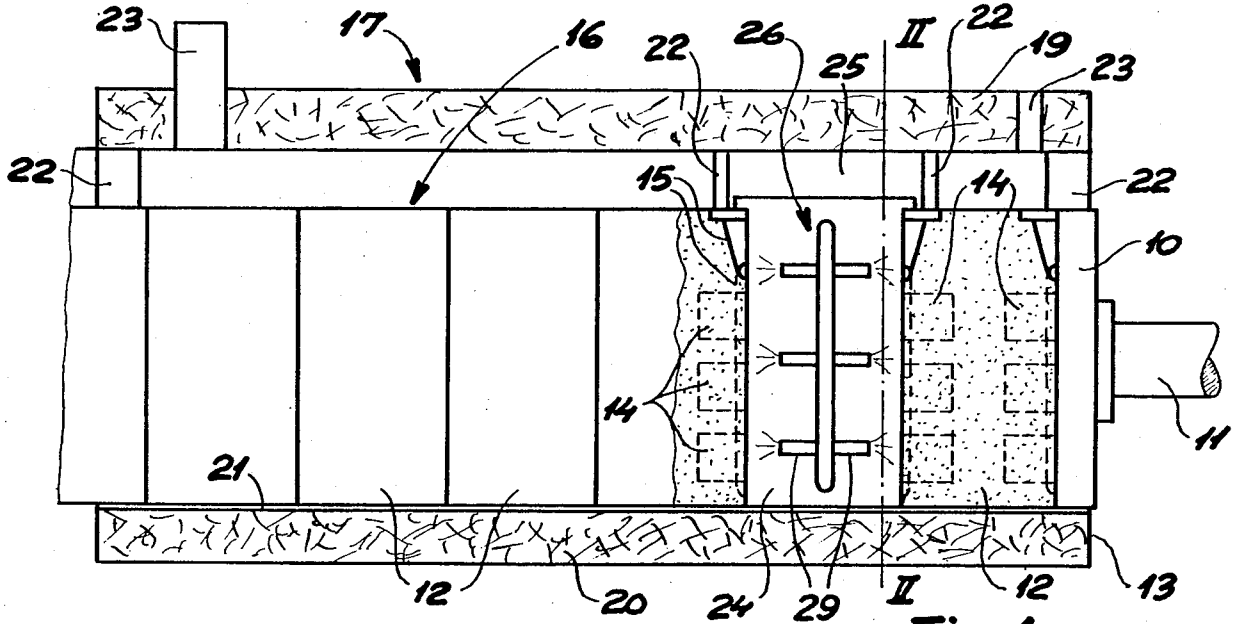

METHOD FOR THE PRODUCTION OF FROZEN MOULD BODIES AND APPARATUS FOR USE IN THE CARRYING OUT OF THE METHOD

This is a continuation of application Ser. No. 448,897 filed Dec. 8, 1982 now U.S. Pat. No. 4,576,215.

The invention relates to a method of and apparatus for the production of frozen mould bodies which include granular material and a binder.

The use of a neutral binder, such as water, and a neutral coolant, such as liquefied nitrogen for freezing the water, totally obviates the environmental pollution which the use of conventional binders and catalysts has produced. It moreover reduces the manufacturing costs and allows the sand to be reused without subesquent treatment.

The known embodiments of the present method, by which the coolant is sprayed or poured into or on the mould body, suffer from the drawback that it takes a relatively long time to freeze the water to a sufficient depth; the object of the invention is to eliminate or significantly reduce this drawback.

This object is achieved in carrying out the method by drawing suction through a porous sand mass to increase significantly the rate at which the freezing agent can be caused to contact the binder in the mould body, resulting in a corresponding reduction in the time required for freezing and additional cooling to the necessary depth.

In an embodiment which provides for rapid penetration of the freezing agent into the mould bodies and which is used in connection with a mould string, the freezing medium is passed direct to the mould faces which later contact the molten metal.

The invention also concerns apparatus or a plant for use in the carrying out of the method, in which freezing is effected in the mould box.

The invention also concerns a mould production apparatus or plant in which the moulds are not frozen until they have left the mould box and have been pushed out on a mould path, and which includes a nozzle assembly mounted to that a vacuum tunnel can be closed by simple means simultaneously with the nozzle assembly being in its operative position between the exposed mould faces.

Figure 2:
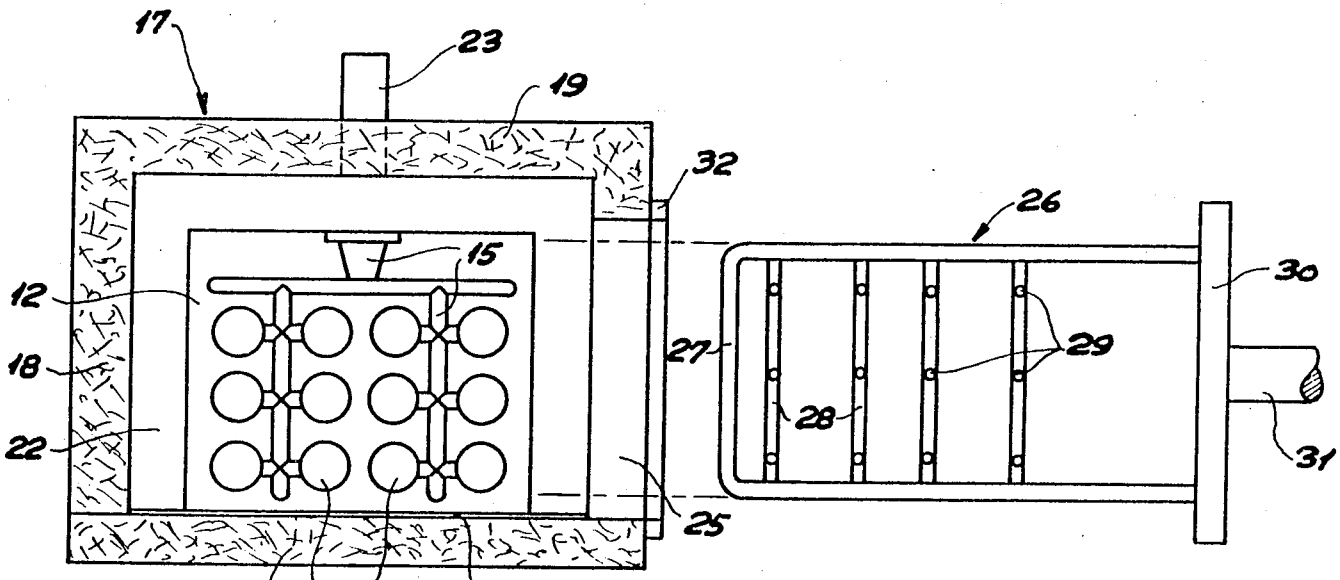
Figure 3:
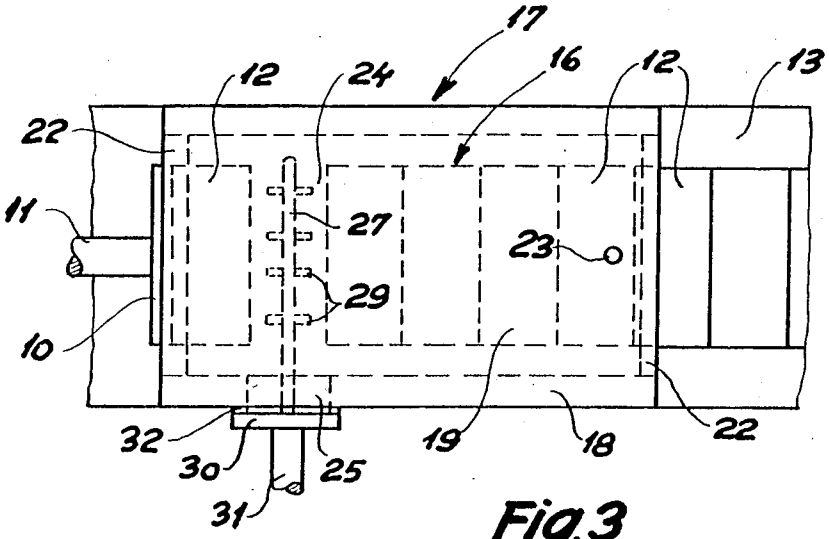

Embodiments of apparatus of plant in accordance with the invention will be described more fully below with reference to the drawing, in which:

FIG. 1 schematically shows an apparatus or a plant, in accordance with the invention as seen from the side and partly in section, with a nozzle assembly in its operative position, FIG. 2 is a cross-sectional view taken along the line II—II in FIG. 1, with the nozzle assembly in its inoperative position, FIG. 3 is a schematical top view of the plant of FIG. 1 on a reduced scale, In the drawing, 10 represents a pattern plate fitted on the piston rod 11 of a hydraulic cylinder (not shown) of a known moulding apparatus or mould producing machine, which moulds and presses each mould between two vertical pattern plates in a frame (not shown), and then one pattern plate is pivoted to a horizontal position and the other pushes the produced mould 12 out of the frame and forwardly to the position shown in FIGS. 1 and 3 on a mould path 13 by means of the hydraulic pressing cylinder. The pattern plates produce mould impressions 14 and impressions 15 which upon juxtapositioning of the moulds form mould cavities and ingates and sprues between each pair of adjacent moulds 12. The said position of the newly formed mould 12 provides a space 24 between this mould and the rear mould in the mould face row 16 formed by the previously produced moulds on the mould path 13.

The rear end of the mould row 16 and the last-formed mould 12 are surrounded by a vacuum and cooling tunnel 17 defined by two side walls 18, a top wall 19 and a bottom 20 of heat insulating material. The bottom 20 constitutes a part of the mould path 13 and supports a slide plate 21 on which the mould 12 can rest and slide. Gaskets 22 are provided at the ends of the tunnel 17, and they extend from the side walls 18 and the top wall 19 towards and resiliently and sealingly engage the mould row 16 and edge faces of the pattern plate 10, respectively, in the pattern plate position shown in FIGS. 1 and 3. Additional gaskets 22 (FIG. 1) are provided on opposite sides of the space 24. Adjacent the front end of the tunnel 17 a through pipe stub 23, which can be connected to a source of vacuum (not shown), is fitted in the top wall 19. Similarly, at the rear end of the tunnel 17, a vacuum hole, also designated by the numeral 23 (FIG. 1), is formed in the top wall 19.

Opposite the space 24 between the last-formed mould 12 and the rear end of the mould row 16 one tunnel side wall 18 is formed with an opening 25 through which a freezing agent applying device in the form of a nozzle assembly generally designated by 26 can be inserted into the space 24. The nozzle assembly 26 is formed by a U-shaped frame 27, between the legs of which there extends a plurality of vertical pipes 28, which each carry a plurality of nozzle pipes 29 disposed end to end in pairs and extending in parallel with the mould path; in the active position of the nozzle assembly shown in FIGS. 1 and 3 one half of the nozzle pipes 29 are rearwardly directed towards the mould face of the last-formed mould 12, the other half being forwardly directed towards the exposed mould face of the rear mould in the mould row 16.

The nozzle assembly 26 is secured to and extends perpendicularly from a closing plate 30 placed at the end of the piston rod 31 in a hydraulic cylinder (not shown), which is capable of reciprocating it between the position shown in FIG. 2, in which the entire nozzle assembly is disposed outside the vacuum and cooling tunnel 17, and the position shown in FIGS. 1 and 3 with the nozzle assembly disposed in the space 24 between the moulds. In the second position the edge portions of the closing plate sealingly engage a gasket 32 fitted circumferentially in the edge of the opening 25 in the side wall of the tunnel 17.

The nozzle assembly 26 is connected to a source of a liquefied freezing agent, e.g. nitrogen, by means (not shown) comprising a non-return valve. In the active position of the nozzle assembly 26 the freezing agent is sprayed on the two mould faces directed towards the nozzle assembly, and the vacuum simultaneously applied on the outer faces of the module present in the vacuum and cooling tunnel 17 causes the freezing agent to be drawn rapidly into the moulding sand and to cool the water in the sand below the freezing point, so that the water will turn into ice which binds the sand grains together. After this freezing process the supply of coolant to the nozzle assembly 26 is interrupted, and the nozzle assembly is withdrawn from the tunnel 17 to the position shown in FIG. 2. The drive cylinder for the pattern plate 10 then pushes the last-formed mould 12 into engagement with the mould row 16 and additionally pushes the entire mould row a distance forwards corresponding to the thickness of a mould. This mould row movement can be supported by a generally known advancing mechanism (not shown). After the completion of the advancing movement the pattern plate 10 returns to its operative position in which it can cooperate with the other pattern plate (not shown) to produce a new mould.

Owing to considerations of space it may be expedient in practice to mount the moving cylinder (not shown) for the closing plate 30 and the nozzle assembly 26 above the tunnel 17 instead of at its side, as indicated in FIG. 2. The shown and described plant can also be modified in many other ways.

Plants according to the invention may assume many other shapes than the one shown and described in the foregoing. It may e.g. be formed by a closed, heat insulated box in which one or more sand moulds or cores may be placed and which may be evacuated and then be supplied with liquefied coolant, which because of the evacuation penetrates rapidly into the mould bodies and freezes at least part of the water in it.

This effect will be greatly enhanced when the mould bodies are formed by a string of juxtaposed moulds like the one shown in FIGS. 1 and 3 and the means for supplying freezing agent are adapted to supply this agent direct to the ingates 15 of the moulds.

I claim:

1. A method of producing frozen mould bodies which include granular material and a binder, which comprises:

forming a first mould body of the granular material and the binder in a moulding position;

moving the first mould body along a mould body path into a position spaced from the moulding position such that a freezing agent applying device subsequently can be inserted between the first mould body and a second mould body formed in the moulding position;

forming a second mould body of the granular material and the binder in the moulding position;

inserting the freezing agent applying device between the spaced first and second mould bodies to apply a freezing agent to opposed mould faces of the first and second mould bodies simultaneously;

applying a vacuum to other portions of the mould bodies simultaneously to draw the freezing agent into the mould bodies so as to freeze the binder in at least portions of the mould bodies adjacent the opposed mould faces;

withdrawing the freezing agent applying device from between the spaced first and second mould bodies after the freezing agent has been drawn into the mould bodies by vacuum; and moving the second mould body out of the moulding position along the mould body path into engagement with the first mould body such that the second mould body moves the first mould body further along the mould body path and such that the second mould body is moved into the position spaced from the moulding position.

2. Apparatus for producing frozen mould bodies which include granular material and a binder, wherein the mould bodies are formed in a moulding position in succession, which comprises:

movable means for moving each of the formed mould bodies out of the moulding position after the mould body has been formed, such that the mould body and a next formed mould body in the moulding position are in spaced relationship and have opposed spaced mould faces in opposed relationship;

means for applying a freezing agent to the opposed spaced mould faces of the spaced mould bodies simultaneously;

means for applying vacuum to other portions of the spaced mould bodies simultaneously to draw the freezing agent into the mould bodies so as to freeze the binder in at least portions of the mould bodies adjacent the opposed spaced mould faces;

an elongated sealed vacuum chamber through which the mould bodies are moved by the movable means, the freezing agent applying means being movable and the elongated chamber having an opening in a sidewall thereof through which the freezing agent applying means can be moved; and means for reciprocating the freezing agent applying means through the opening in the sidewall of the elongated chamber between an inoperative position outside the elongated chamber and an operative position within the elongated chamber between successive ones of the formed mould bodies.

3. Apparatus as recited in claim 2, which further comprises:

a sealing member movable with the reciprocating means for the freezing agent applying means, for sealing the opening in the sidewall of the elongated chamber when the freezing agent applying means is moved into its operative position.

* * * * *